US007270121B2

(12) United States Patent
Lubben

(10) Patent No.: US 7,270,121 B2
(45) Date of Patent: Sep. 18, 2007

(54) PAINTBALL BACKPACK HOPPER WITH POSITIVE FEED DEVICE TO DELIVER PAINTBALLS TO A PAINTBALL GUN WITHOUT JAMMING PROBLEMS

(76) Inventor: Curtis Robert Lubben, 12057 Caminito Ryone, San Diego, CA (US) 92128

( * ) Notice: Subject to any disclaimer, the term of this patent is extended or adjusted under 35 U.S.C. 154(b) by 0 days.

(21) Appl. No.: 11/141,752

(22) Filed: Jun. 1, 2005

(65) Prior Publication Data

US 2005/0274371 A1 Dec. 15, 2005

(51) Int. Cl.
*F41B 11/02* (2006.01)

(52) U.S. Cl. ..... 124/51.1

(58) Field of Classification Search ..... 124/45, 124/51.1, 52, 53, 53.5
See application file for complete search history.

(56) References Cited

U.S. PATENT DOCUMENTS 6,055,975 A * 5/2000 Gallagher et al. ..... 124/50
6,327,953 B1 * 12/2001 Andresen ..... 89/33.17
6,609,511 B2 * 8/2003 Kotsiopoulos et al. ..... 124/51.1
6,644,293 B2 * 11/2003 Jong ..... 124/52

* cited by examiner

*Primary Examiner*—John A. Ricci
(74) *Attorney, Agent, or Firm*—Eric Hanscom

(57) ABSTRACT

This invention is directed toward a device and method of providing a substantial quantity of paintballs to a paintball gun in a manner which minimizes the target silhouette of the user and allows him/her to supply the paintball gun with relative ease, safety, and efficiency in that he/she does not have to reach for paintball pods to refill his/her marker. A force-feed mechanism removes paintballs from the backpack hopper and feeds them into the marker, while a ratcheting ceiling communicates with a sensor and brings the ceiling of the backpack hopper down on the remaining paintballs as more are fired to ensure that there is a constant pressure feeding the remaining paintballs into the force feed mechanism. The invention also optionally provides for an air canister located in the backpack hopper which even further lowers the player's profile as a target and protects the canister from damage.

14 Claims, 3 Drawing Sheets

PAINTBALL BACKPACK HOPPER WITH POSITIVE FEED DEVICE TO DELIVER PAINTBALLS TO A PAINTBALL GUN WITHOUT JAMMING PROBLEMS

CROSS REFERENCE TO RELATED APPLICATIONS

None.

STATEMENT REGARDING FEDERAL FUNDING

There was no federal funding related to this application.

SUMMARY OF THE INVENTION

This invention is directed toward a device and method of providing a substantial quantity of paintballs to a paintball gun in a manner which minimizes the target silhouette of the user and allows him/her to supply the paintball gun with relative ease, safety, and efficiency in that he/she does not have to reach for paintball pods to refill his/her marker. A force-feed mechanism removes paintballs from the backpack hopper and feeds them into the marker, while a ratcheting ceiling communicates with a sensor and brings the ceiling of the backpack hopper down on the remaining paintballs as more are fired to ensure that there is a constant pressure feeding the remaining paintballs into the force feed mechanism. The invention also optionally provides for an air canister located in the backpack hopper which even further lowers the player's profile as a target and protects the canister from damage.

BACKGROUND OF THE INVENTION

Paintball appears to have originated as a method for farmers and ranchers to quickly and effectively mark tress and livestock. A paintball is a sphere filled with one of several colors of paint, contained by a hard, semi-brittle surface that breaks upon contact with another surface. The paintballs are shot out of a paintball gun, which is also called a "marker". An air canister attached to the paintball gun supplies the power to propel the paintball up to several hundred yards, although the effective range is usually under 150 feet, and the ideal distance to target is less than 80 feet, at a velocity around 190 mph.

During the early 1980's, it became an organized activity during which teams of paintball players would hunt one another in either an indoor or outdoor paintball arena. In paintball games the object is to shoot a player on the opposing team such that your paintball bursts or breaks on his/her clothing or paintball gun, creating an obvious stain. All persons so marked by a paint splatter over a certain size (usually the size of a quarter) are supposed to put their paintball gun in the air and walk off the playing field.

By the end of the 1980's there were a number of paintball arenas throughout the world, ranging in quality from carefully designed indoor locations to cordoned-off outdoor lots where the only protection from enemy fire were naturally growing trees and naturally occurring hills and valleys. The goals of paintball games also expanded, from an initial "capture the flag" approach to the currently popular goal of shooting every member of the opposing team before they shoot every member of your team, commonly referred to as "elimination".

As the playing fields, rules, and cash prizes for paintball competitions have grown, there have been concurrent advances in the technology. Two of the major areas of improvement from the beginning have been to a) decrease the target size of a paintball player by making accessories small and/or locating them in front of or behind the person (as opposed to having accessories hang to the side of the player, thereby increasing the player's silhouette and target size), and b) facilitate a rapid re-supply of paintballs to the paintball gun.

An average paintball gun can only store around 200 paintballs in its hopper, depending upon the size of the hopper. It should be noted that the larger the hopper, the larger the target presented to an opponent since the hopper typically sits directly on top of the gun. One of the main goals in improving paintball gear is to decrease the effective target size a player presents so that it is more difficult to hit him or her with a shot paintball. Thus, once a user has exhausted the hopper, he/she needs to replenish the paintballs. There have been invented a number of ways to accomplish this, the most common being the use of paintball "pods", which currently come in sizes of 100 and 140 paintballs. Prior methods of storing pods include placing them on belt loops. This method has obvious drawbacks: if the pods are placed on a person's hips, they will effectively increase the target area, thereby rendering a user more likely to get shot; if the pods are attached to the front or back, a user increases the chances of crushing the paintballs by falling on them. There is an additional problem in cases where the pods are placed in a holder or belt that stores the pods behind the player's back: namely, that it is time consuming, difficult, and anatomically uncomfortable to have to reach behind one's back to retrieve a pod There have also been methods suggested whereby a positive feed system will force a paintball into the chamber for firing, however few of these systems have done more than merely trying to eliminate jams at the bottom of a hopper—the paintball player is still limited by the size of the hopper and the number (and ease of access) of paintball pods he/she carries during a game of paintball. One force feed device which is out on the market takes paintballs out of the hopper, via gravity, and force feeds them into the chamber. This device, however, also increases the target profile presented by the user and still relies on gravity to get the ball from the hopper to the chamber. Another product on the market uses the actual pod as the hopper, and locates the pod beneath the paintball gun whereupon the paintballs are transported up to the gun through a unique spring/spiral combination. This device, however, still locates the hopper, or pod in this case, in a location where the player's target profile is enlarged by having an additional device in front of the player. Additionally, this pod/hopper only holds 100 paintballs, requiring a player to frequently reload or replace the pod/hopper, and both of these options require the player to carry additional pods or reloading, or pod/hoppers for replacing and empty pod/hopper.

Since decreasing a player's target size is a major goal of paintball innovations, it should be noted that in the majority of paintball games, a hit on the hopper counts as a hit, which removes that player from the game. This is particularly important when a player is firing from behind a barrier, as the hopper becomes visible (and therefore a target) to opposing players before the gun is raised to a position from which it can fire. Thus, an invention which does away with a hopper located above the actual gun would be highly advantageous to both the recreational and tournament paintball player.

An additional problem with the use of paintball hoppers is that paintballs can jam in the hopper exit, thereby stopping a paintball enthusiast's game until he/she can open the hopper and remove the jam, or takes the time to shake the gun in the hopes of removing the jam. Thus, there exists a long-felt need for a reliable system by which a continuous supply of paintballs can be loaded in the chamber of a paintball gun for rapid firing in a manner which is not dependant upon gravity and allows a paintball player to effectively reload his/her gun from any position without the need to first stop firing before reloading.

A final problem with the current paintball gun arrangement in many models is that the air canister is located just below the handle of the gun, thereby increasing the target size of the user and the effective size of the gun. Since decreasing a user's silhouette will decrease the chances of his/her being hit, it is advantageous to locate the air canister in a location where it will be "hidden" from an opposing player.

The current invention provides a simple, cost-effective solution to both of these problems: a paintball backpack hopper that presents a much smaller target than do other means of providing replacement paintballs, and does so with positive force, thereby substantially decreasing the likelihood of a jam at the bottom of the hopper. By providing a supply of around 1,000 paintballs—a number well above that used by the average recreational paintball user during a game—the user can devote all of his/her attention to shooting other players and avoid being shot first, and doesn't need to divert his/her attention to reloading.

BRIEF SUMMARY OF THE INVENTION

The primary object of this invention is to provide a fast, safe, and effective means of replenishing paintballs during a paintball game through the use of a backpack hopper which can be filled with an enormous quantity of paintballs, combined with a positive force feeding mechanism which delivers the paintballs to the paintball gun in a rapid and efficient manner.

Another object of this invention is minimizing the target area presented by the additional paintballs by locating the paintball supply in a backpack rather than in a gun-mounted hopper, paintball pod or other accessory which increases a player's silhouette or target area, such as a top or side-feed mechanism or hopper.

An additional object of this invention is to have a ratcheting ceiling on the backpack hopper so that the paintballs will always be available at the entrance to the positive force feeding mechanism regardless of the position of the paintball player, thus, by ratcheting down upon the remaining paintballs, a player can shoot from a standing, kneeling, prone or even upside-down position and always have paintballs feeding into the force feed mechanism.

A final object of the invention is to protect and locate the air canister in a location which will not only cushion the air canister against the normal falls and dropping associated with the game of paintball, but also put the air canister in a location—namely right on the player's back—where it will present a lesser target than it would if located in a traditional location such as under the player's marker.

Other objects and advantages of the present invention will become apparent from the following description, taken in connection with the accompanying drawings, wherein, by way of illustration and example, and embodiment of the present invention is disclosed.

DETAILED DESCRIPTION OF THE INVENTION

This invention is directed toward a method of providing a substantial quantity of paintballs to a paintball gun in a manner which minimizes the target silhouette of the user and allows him/her to supply the paintball gun with relative ease, safety, and efficiency in that he/she does not have to reach for paintball pods.

Figure 1:
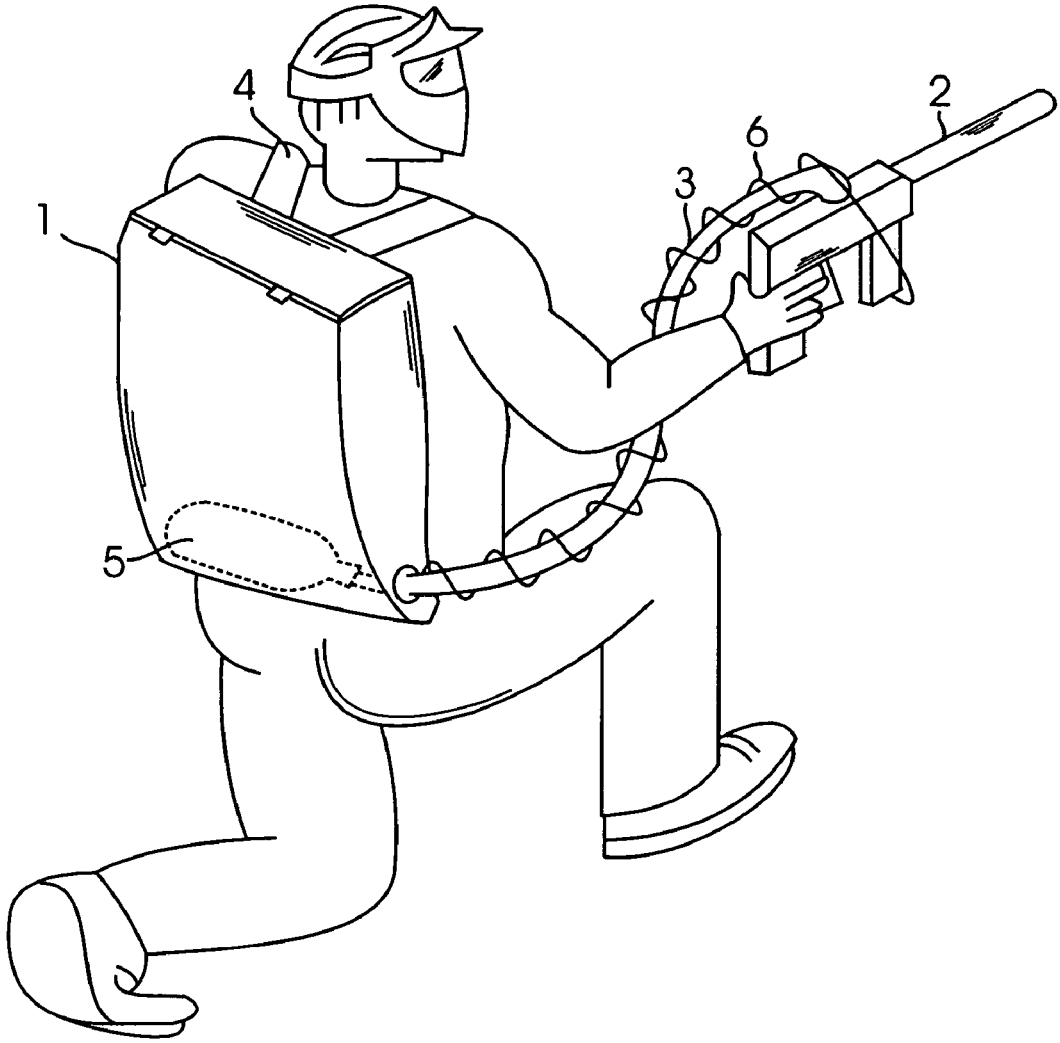
FIG. 1 is a back, elevational view of a paintball player using the invention, including a backpack hopper with a positive feed device at its bottom, and a feed tube which carries paintballs from the backpack hopper to the paintball gun.

The invention comprises several components, as illustrated in FIG. 1. There is a backpack hopper (1) designed to store a set number of paintballs, ranging from a "recreational player" backpack which could store over 500 but less than 1,000, and a "tournament player" version which could store over 1,000 paintballs (during an average paintball game, an expert player may go through 1,200-1,500 paintballs). At the bottom of the backpack hopper is a positive feed device (not shown in FIG. 1), which delivers a constant source of paintballs to a paintball gun or marker (2) through a feed tube (3). The backpack hopper is attached to the user by shoulder straps (4), Because there is positive feed forcing the paintballs through the feed tube, the user can optimize the effectiveness of the paintball gun as he/she can be constantly shooting rather than having to stop from time to time to reload a traditional hopper which sits on top of the marker.

The backpack hopper is designed as a box, in the shape of a common schoolbook backpack, with a width approximately the distance across an adult's back, a height from near the waist to the shoulders of an adult, and a depth depending on the volume of paintballs desired (the average number of paintballs used by a tournament player can be three or four times what a recreational player uses; thus the depth of the backpack will vary depending on the type of player it is designed for). The invention contemplates two basic versions: the "recreational player" version which would be fairly thin, as recreational players do not usually go through more than 1,000 paintballs in any one given game, and a "tournament player" version which is substantially thicker in depth to accommodate the extra paintballs a tournament player frequently uses. A third, adjustable type of backpack can also be made, in which the backpack depth can be adjusted, thereby making a "recreational/tournament" version possible.

The backpack hopper has an air canister (5) located inside the backpack hopper, from which a supply of air is sent to the marker (2) through an air tube (6). FIG. 1 shows the feed tube (3) coming out of the backpack hopper (1) and going directly to the marker (2). This is merely one of the different iterations of the invention contemplated.

It is important to note that the air canister is located at the bottom of the backpack instead of on the marker or paintball gun, thereby further decreasing the target size of the player, and that there is a curly Q made from a flexible air tubing around the feed tube, which is connected to the air tank on one end and the marker on the other end thereby supplying the marker with the necessary air to power it and can optionally be attached to the feed tube, or can exist separately. The air tube would be hollow, as well as flexible and durable, so as to allow it to convey air from the canister to the gun. This method of having the air canister on the player's back decreases the weight of the gun and increases the mobility of a user. Please note too that the feed tube must be flexible, but cannot stretch, as should the tube stretch it would be possible that a gap between paintballs would form, thereby causing the gun to fire a blank shot in between paintballs. A wire line running the length of the feed tube would ensure that the feed tube did not stretch, and could be made of metal, plastic or some other material rigid enough to maintain the shape of the tube, and yet flexible enough to withstand the rigors associated with the running, crouching and falling of a paintball game. Please note that the wire or length-stabilizing element used to keep the feed tube from stretching is not illustrated in the informal drawings submitted with this application. An electrical, mechanical, or wireless system would also be present which would provide feedback from the backpack hopper to the gun and vice versa, thereby controlling the force feed and ratcheting mechanisms to ensure that the system constantly replenishes the round that was just fired. This iteration of the invention shows the feed tube coming directly from the bottom of the backpack to the marker. It is envisioned, as will be clear from FIG. 2, the another version of the invention allows for the tube to be connected to the outside of the backpack so that the tube releases from the backpack at the shoulder such that the tube then cascades down above the player's right arm and feeds the marker. If should also be noted that the invention envisions backpacks for left-handed and right-handed players, where the feed tube comes from either side of the backpack.

Figure 2:
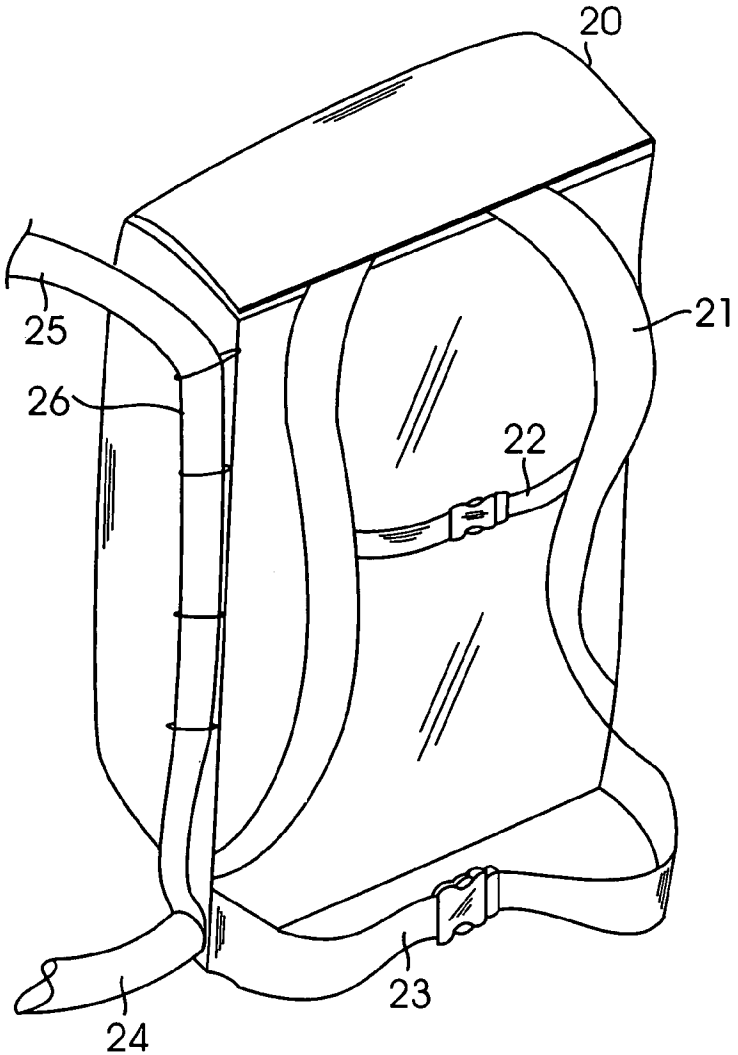
FIG. 2 is a back, elevational view of the invention.

Turning to FIG. 2, the backpack hopper (20) has shoulder straps (21), connected to each other by the chest strap (22), and a hip belt (23), so that a user can wear the backpack and have the weight distributed between the shoulders and hips, and prevent the backpack from bouncing around while the player runs. FIG. 2 also illustrates two of the possible designs of the feed tube. In one iteration, the feed tube (24) goes directly to the marker (not shown in this figure) such that the feed tube (24) goes under the user's arm; in another iteration, the feed tube (25) is attached to the outside of the backpack hopper (20) with one or more means of attachment (26) which may include wire, plastic, cinch ties, or other means, such that the feed tube (25) goes over the user's arm.

Figure 3:
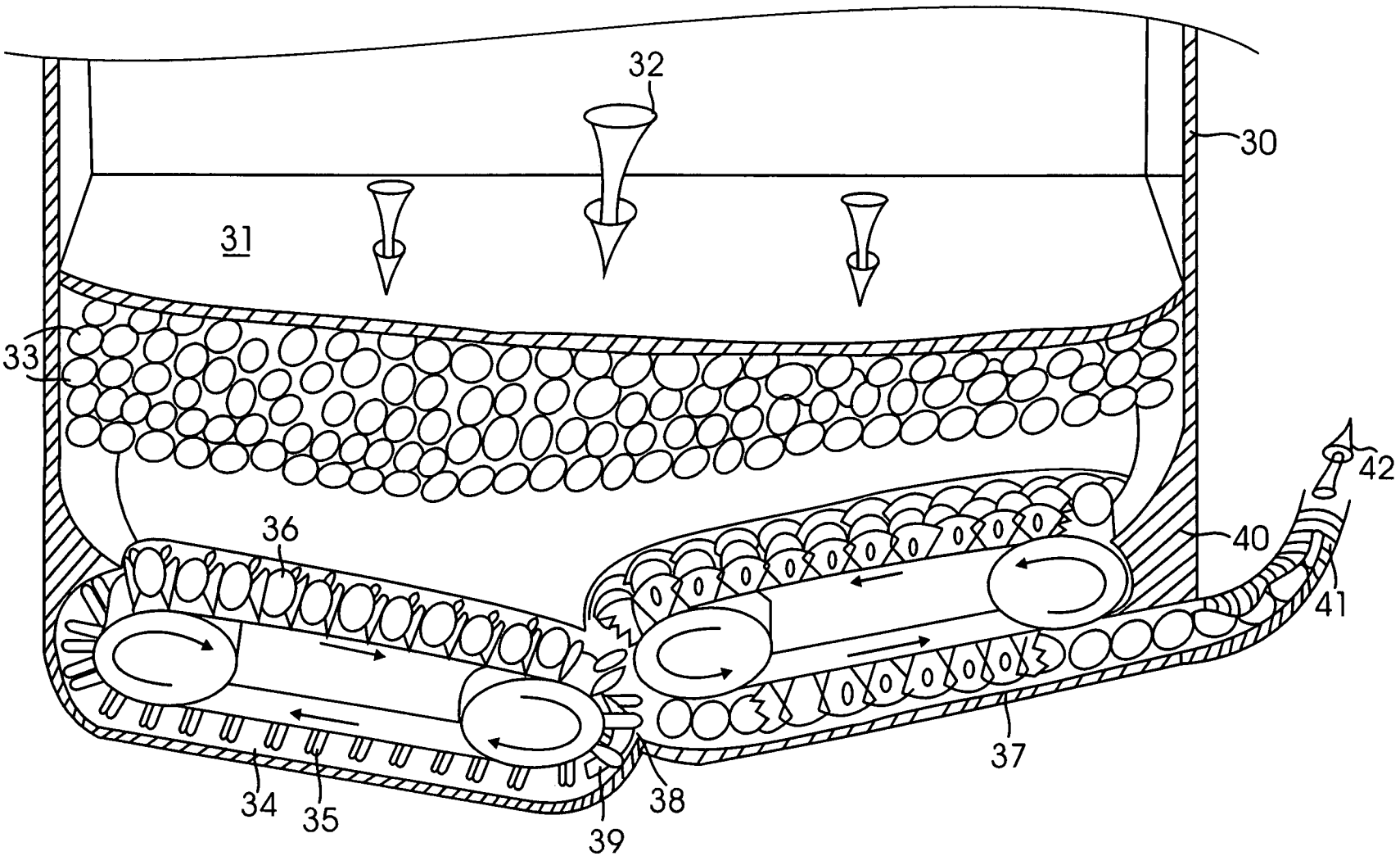
FIG. 3 is a cross sectional view of the bottom of the backpack hopper, with the wall of the backpack hopper removed, showing the two belt devices which make up the positive feed device.

FIG. 3 illustrates the force feed mechanism. Inside the backpack hopper (30) is a ratcheting ceiling (31) which, as a paintball user goes through the paintballs, moves down (in a direction indicated by (32)) on the remaining paintballs (33) to keep them pressed against the positive feed device, thereby ensuring a constant supply of paintballs regardless of the position of the paintball player. For example, without a ratcheting ceiling, if the player shoots from his/her side, the paintballs would all roll to one side of the backpack hopper, thereby not being available for the force feed mechanism. This ratcheting ceiling (31) can be driven by an inflatable airbag (not shown) on the other side of the ceiling from the paintball supply, or by a mechanical ratcheting device (not shown) which is dependant upon how many paintballs are left in the backpack hopper. The ratcheting function can be powered by air from the air canister by means of a split line and a regulator that will decrease the pressure from the air canister. There is also a sensor mechanism (not shown) that detects when a paintball round has been fired, thereby triggering the conveyor belt system to feed another round into the tube, which then presses another round into the chamber.

This sensor is connected to the gun in a manner that allows the backpack harness and the gun to communicate with each other. One method of this is to have an electrical cable attached to or wrapped around the tube which feeds paintballs from the backpack to the gun and connects the gun's electronics to the hopper's electronics. Another method would be an infrared or other wireless connection between the backpack and the gun. Another method would be to have an electronic laser eye sensor, connected to the controlling mechanism in the hopper in any way, that can see the space that a ball would occupy before it is chambered and advance the conveyor if this space was vacant. An additional method would be to have the 'blowback' (the air that gets misdirected out the chamber) from the fired shot activate a sensor.

At the bottom of the backpack hopper is the positive feed device. There are two basic belt devices which make up this means of supplying the feed tube with a constant source of paintballs. A first belt device (34) works on a conveyer belt principle and has spacers (35) which create pockets along the conveyer belt which are the right size for a paintball to fall into. Once a paintball has fallen into such a pocket (36), it is transported toward a second belt device (37), propelled by the spacer behind it.

Figure 4:
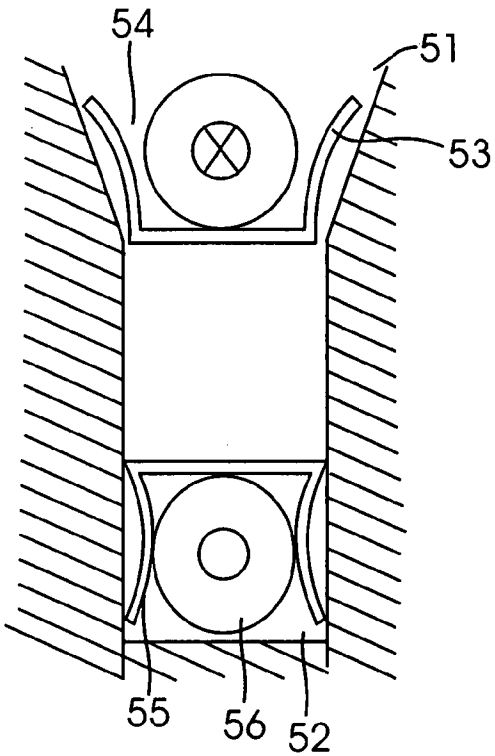
FIG. 4 is a cross sectional view of the second belt device showing how a paintball can be first slotted into the top track, then clasped as it falls into the bottom track of the conveyer belt.

The second belt device (37) has a slot on its top into which paintballs can fall (described in more detail in FIG. 4). The slot is made up of the walls of the backpack, which are narrow enough to funnel the paintballs onto the conveyer belt. Along either side of this slot are clasps, which are an integral part of the conveyor belt. When the conveyor belt is above the rotating gears, the clasps are in an "open" position where they do not cinch down upon or grasp the paintball, and are kept in this open position by the lack of pressure from the walls of the slot, which angles out at approximately 60 degrees. Thus, there is a ready supply of paintballs on the slot on top of the second belt device (37) to fill any vacancies in the top of the belt of the first belt device (34) when the top of the first belt device and the top of the second belt device meet at the belt junction (38).

At the belt junction, paintballs from the first belt device are transferred to the second belt device. There is a small deflector (39) that forcibly releases the balls from the first conveyer belt onto the second conveyer belt, via a small prong that slides into the slits down the middle of the first conveyor belt which forces the balls off the first conveyor belt onto the second conveyor belt. The bottom of the slot on the second belt device has walls that rise 90 degrees from the top of the slot, thereby putting pressure on the clasps to fold in on the paintball and secure it as it is carried to the feed tube. A feed tube deflector (40) prevents the paintballs from following the second belt device as it circles around the drive gear. As the paintballs are deflected, they are forced into the feed tube (41), thereby forcing the paintballs already in the tube toward the paintball gun, a direction indicated by (42). At the bottom of the inside of the backpack hopper, the sides are slanted such that paintballs are funneled into the force feed mechanism.

It is important to note that should the paintball player stop shooting paintballs from the marker, the force feed mechanism and conveyer belt devices will stop turning when a sensor located in the feed tube detects that there is pressure building up in the feed tube from paintballs being force fed into the feed tube and none being released from the feed tube by being shot out of the marker. When this happens, the sensor will cause the first belt device and the second belt device to stop turning. This "shut down" will remain in effect until the player begins shooting paintballs again. It is important that the sensor stops the advancement of balls being force fed into the feed tube, so that the paintballs are not crushed by the pressure of the conveyor. Should this happen, the feed tube would probably jam, and the internal machinery of the marker, the feed tube, and the backpack hopper could be damaged by dripping paint from the crushed paintballs coming into contact with sensitive electronic components or delicate gears.

Turning now to FIG. 4, to feed the balls onto the conveyor belt, the walls of the backpack narrow into "slots" above (51) and below (52) the conveyor belts, in which the width and angle of the slots becomes important with respect to what happens to the clasps, a part of the second conveyor belt, when they travel through wide and narrow slots. The slots are in reality the conveyor belt's enclosures. The clasps (53) are pressured by a spring or some other means to naturally move out, into an "open" position (54), unless the slot narrows, in which case the walls of the slot push inward on the clasps, causing them to cinch together into a "closed" position (55), thereby grasping the paintball (56).

The drawing constitutes a part of this specification and includes exemplary embodiments to the invention, which may be embodied in various forms. It is intended that in some instances various aspects of the invention may be shown exaggerated or enlarged to facilitate an understanding of the invention.

What is claimed is:

1. A device to provide a steady supply of paintballs to a paintball gun, comprising:

a backpack hopper which can contain at least 500 paintballs, which consists of a cavity defined by six sides made of plastic or a similar strong and rigid material, and two or more shoulder straps;

a sensor mechanism which senses the removal of paintballs from the backpack hopper and conveys that information to a mechanism which causes the space in which unused paintballs are resting to decrease in volume;

a positive feed device attached to or as a part of the backpack hopper; and a feed tube which carries the paintballs from the backpack hopper to the paintball gun, where the positive feed device comprises:

a first belt device consisting of a conveyer belt rotating around two drive gears, where the conveyer belt has sets of spacers embedded on it which are located such that a paintball fits in between each set;

a slot above the top of the first belt device where the walls of the slot are wide enough to accommodate one paintball;

a second belt device consisting of a conveyer belt rotating around two drive gears, with an upper side and a lower side, where the conveyer belt has a series of clasps which can grasp a paintball when force is applied to the outside of each clasp;

a sensor in the feed tube which detects when the player is no longer shooting his/her marker and releasing paintballs from the backpack hopper, where, when the sensor detects pressure building up between two or more paintballs in the feed tube, the sensor causes the first belt device and the second belt device to stop turning;

a top slot above the top of the second belt device where two walls of the slot extend diagonally out approximate 60 degrees, thereby allowing for paintballs above the slot to filter down into the slot, the 60 degree walls allowing for the clasps to remain in an "open" position such that they do not grasp the paintballs;

a bottom slot below the bottom side of the conveyer belt, the walls of which extend down at a 90 degree angle to the conveyer belt to a second belt slot bottom, thereby putting pressure on the clasps such that the clasps grasp each paintball as it is deposited onto the second belt slot bottom, such that each paintball is forcefully propelled along the bottom slot;

a feed tube deflector which constricts the bottom slot such that it allows only the conveyer belt and the clasps to leave the bottom slot and continue around the drive gear, thereby forcing the paintballs into a feed tube; and where the feed tube additionally comprises a hollow, flexible length of plastic, rubber or other sturdy, resilient, and flexible material, which takes the paintballs from the bottom slot and delivers them to the paintball gun.

2. The device of claim 1, where, the backpack hopper has a hip belt which attaches around the waist of a user.

3. The device of claim 2, where, the shoulder straps are connected to each other by a chest strap.

4. The device of claim 1, where, the mechanism which causes the space in which unused paintballs are resting to decrease in volume is a ratcheting ceiling, located inside the backpack hopper, which moves down upon the remaining paintballs as the user shoots paintballs, and where the ratcheting ceiling is powered by an inflatable bag in between the top of the backpack hopper and the ratcheting ceiling, which is designed to inflate to take up additional space as more paintballs are fired.

5. The device of claim 1, where, there are internal supports to maintain the shape of the backpack.

6. The device of claim 1, where, there are external supports to maintain the shape of the backpack.

7. The device of claim 1, where, the backpack is made from a sturdy fabric which is rigid enough to hold its shape when filled with paintballs.

8. The device of claim 1, where, the backpack hopper additionally comprises an air canister which supplies a supply of air to a marker through an air tube.

9. A device to provide a steady supply of paintballs to a paintball gun, comprising:

a backpack hopper which can contain at least 500 paintballs, which consists of a cavity defined by six sides made of plastic or a similar strong and rigid material, and two or more shoulder straps, where the shoulder straps are connected to each other by a chest strap, and where there is a support for the backpack hopper;

a feed tube which carries the paintballs from the backpack hopper to the paintball gun;

a sensor in the feed tube which detects when the player is no longer shooting his/her marker and releasing paintballs from the backpack hopper, where, when the sensor detects pressure building up between two or more paintballs in the feed tube, the sensor causes a first belt device and a second belt device to stop turning;

a hip belt which attaches around the waist of a user;

a mechanism located inside the backpack hopper which causes the space in which unused paintballs are resting to decrease in volume as the user shoots paintballs; where, the mechanism is a ratcheting ceiling, and a positive feed device attached to or as a part of the backpack hopper, where, the positive feed device comprises:

a first belt device consisting of a conveyer belt rotating around two drive gears, where the conveyer belt has sets of spacers embedded on it which are located such that a paintball fits in between each set;

a slot above the top of the first belt device where the walls of the slot are wide enough to accommodate one paintball, a second belt device consisting of a conveyer belt rotating around two drive gears, with an upper side and a lower side, where the conveyer belt has a series of clasps which can grasp a paintball when force is applied to the outside of each clasp, a top slot above the top of the second belt device where two walls of the slot extend diagonally out approximate 60 degrees, thereby allowing for paintballs above the slot to filter down into the slot, the 60 degree walls allowing for the clasps to remain in an "open" position such that they do not grasp the paintballs, a bottom slot below the bottom side of the conveyer belt, the walls of which extend down at a 90 degree angle to the conveyer belt to a second belt slot bottom, thereby putting pressure on the clasps such that the clasps grasp each paintball as it is deposited onto the second belt slot bottom, such that each paintball is forcefully propelled along the bottom slot, a feed tube deflector which constricts the bottom slot such that it allows only the conveyer belt and the clasps to leave the bottom slot and continue around the drive gear, thereby forcing the paintballs into a feed tube, and a feed tube comprising a hollow, flexible length of plastic, rubber or other sturdy, resilient, and flexible material, which takes the paintballs from the bottom slot and delivers them to the paintball gun.

10. The device of claim 9, where, the ratcheting ceiling is powered by an inflatable bag in between the top of the backpack hopper and the ratcheting ceiling, which is designed to inflate to take up additional space as more paintballs are fired.

11. The device of claim 9, where, the ratcheting ceiling is powered by a mechanical device, which is designed to ratchet the ratcheting ceiling down to take up additional space as more paintballs are fired.

12. The device of claim 9, where, the support is selected from a group consisting of internal supports, and a sturdy fabric from which the backpack hopper is made which is sufficiently stiff to provide adequate support to keep the backpack hopper from collapsing during use.

13. The device of claim 9, where, the backpack hopper additionally comprises an air canister located within the cavity for the purpose of supplying the paintball gun.

14. A method of supplying paintballs to a paintball gun during a paintball game, comprising the steps of:

obtaining a backpack hopper, comprising:

a backpack hopper which can contain at least 500 paintballs, which consists of a cavity defined by six sides made of plastic or a similar strong and rigid material, and two or more shoulder straps, a sensor mechanism which senses the removal of paintballs from the backpack hopper and conveys that information to a mechanism which causes the space in which unused paintballs are resting to decrease in volume, a feed tube which carries the paintballs from the backpack hopper to the paintball gun, a sensor in the feed tube which detects when the player is no longer shooting his/her marker and releasing paintballs from the backpack hopper, where, when the sensor detects pressure building up between two or more paintballs in the feed tube, the sensor causes a first belt device and a second belt device to stop turning, and a positive feed device coupled to the backpack hopper, where, the positive feed device comprises:

a first belt device consisting of a conveyer belt rotating around two drive gears, where the conveyer belt has sets of spacers embedded on it which are located such that a paintball fits in between each set, a slot above the top of the first belt device where the walls of the slot are wide enough to accommodate one paintball, a second belt device consisting of a conveyer belt rotating around two drive gears, with an upper side and a lower side, where the conveyer belt has a series of clasps which can grasp a paintball when force is applied to the outside of each clasp, a top slot above the top of the second belt device where two walls of the slot extend diagonally out approximate 60 degrees, thereby allowing for paintballs above the slot to filter down into the slot, the 60 degree walls allowing for the clasps to remain in an "open" position such that they do not grasp the paintballs, a bottom slot below the bottom side of the conveyer belt, the walls of which extend down at a 90 degree angle to the conveyer belt to a second belt slot bottom, thereby putting pressure on the clasps such that the clasps grasp each paintball as it is deposited onto the second belt slot bottom, such that each paintball is forcefully propelled along the bottom slot, a feed tube deflector which constricts the bottom slot such that it allows only the conveyer belt and the clasps to leave the bottom slot and continue around the drive gear, thereby forcing the paintballs into a feed tube, and a feed tube comprising a hollow, flexible length of plastic, rubber or other sturdy, resilient, and flexible material, which takes the paintballs from the bottom slot and delivers them to the paintball gun;

attaching the backpack hopper to a marker; and engaging in a game of paintball.

* * * * *